US010415318B2

(12) United States Patent
Johnson et al.

(10) Patent No.: US 10,415,318 B2
(45) Date of Patent: Sep. 17, 2019

(54) EXPANDABLE REAMER

(71) Applicant: SCHLUMBERGER TECHNOLOGY CORPORATION, Sugar Land, TX (US)

(72) Inventors: Ashley Bernard Johnson, Cambridge (GB); Jonathan Robert Hird, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 185 days.

(21) Appl. No.: 15/102,039

(22) PCT Filed: Dec. 8, 2014

(86) PCT No.: PCT/US2014/068991
§ 371 (c)(1),
(2) Date: Jun. 6, 2016

(87) PCT Pub. No.: WO2015/085288
PCT Pub. Date: Jun. 11, 2015

(65) Prior Publication Data

US 2016/0305190 A1 Oct. 20, 2016

(30) Foreign Application Priority Data

Dec. 6, 2013 (GB) ..... 1321625.4

(51) Int. Cl.
*E21B 10/32* (2006.01)
*E21B 17/10* (2006.01)
*E21B 7/28* (2006.01)

(52) U.S. Cl.
CPC ..... *E21B 10/32* (2013.01); *E21B 7/28* (2013.01); *E21B 17/1078* (2013.01); *E21B 17/1092* (2013.01)

(58) Field of Classification Search
CPC .... E21B 10/322; E21B 10/32; E21B 17/1078; E21B 7/28; E21B 10/42; E21B 10/43; E21B 17/1092
See application file for complete search history.

(56) References Cited

U.S. PATENT DOCUMENTS 4,431,065 A 2/1984 Andrews
4,499,959 A 2/1985 Grappendorf et al.
(Continued)

FOREIGN PATENT DOCUMENTS

CN 102086756 A 6/2011
EP 0385673 A1 9/1990
(Continued)

OTHER PUBLICATIONS

Search Report and Written Opinion of International Patent Application No. PCT/US2014/068991 dated Mar. 25, 2015, 14 pages.
(Continued)

*Primary Examiner* — Daniel P Stephenson

(57) ABSTRACT

An expandable reamer for a borehole has a plurality of support elements (202) distributed around a central axis of the tool with cutters (234, 236) and stabilising pads (250) on the support elements, arranged such that at least one of the support elements comprises at least one region comprising cutters and at least one support element comprises a stabilising pad having a front surface positioned to face the wall of the borehole. The reamer includes drive mechanism for expanding the support elements (202) radially outwardly from the central axis. The support elements differ in the presence or axial positions of stabilising pads (250) thereon such that at least one support element differs from at least one other support element in the presence or axial position
(Continued)

of at least one stabilising pad. This arrangement allows the stabilising pads to be positioned at or close to full gauge, thereby reducing vibration.

13 Claims, 12 Drawing Sheets

(56) References Cited

U.S. PATENT DOCUMENTS

| | | | | |
|---|---|---|---|---|
| 4,593,777 | A | 6/1986 | Barr | |
| 4,710,074 | A | 12/1987 | Springer | |
| 4,887,668 | A | 12/1989 | Lynde et al. | |
| 5,341,888 | A * | 8/1994 | Deschutter | E21B 10/322 175/323 |
| 5,967,247 | A | 10/1999 | Pessier | |
| 6,732,817 | B2 | 5/2004 | Dewey et al. | |
| 6,880,650 | B2 | 4/2005 | Hoffmaster et al. | |
| 6,920,923 | B1 | 7/2005 | Pietrobelli et al. | |
| 7,467,671 | B2 * | 12/2008 | Savignat | E21B 10/32 166/174 |
| 7,726,415 | B1 | 6/2010 | Tipton et al. | |
| 7,954,564 | B2 | 6/2011 | Makkar et al. | |
| 7,963,348 | B2 * | 6/2011 | Laird | E21B 7/28 175/263 |
| 7,975,783 | B2 | 7/2011 | Fanuel et al. | |
| 8,205,689 | B2 * | 6/2012 | Radford | E21B 17/1078 175/268 |
| 8,297,381 | B2 | 10/2012 | Radford et al. | |
| 8,550,188 | B2 | 10/2013 | Makkar et al. | |
| 8,752,649 | B2 * | 6/2014 | Isenhour | E21B 10/26 175/399 |
| 8,776,912 | B2 * | 7/2014 | Makkar | E21B 7/28 175/263 |
| 8,905,126 | B2 * | 12/2014 | Krieg | E21B 37/02 166/174 |
| 9,068,407 | B2 * | 6/2015 | Radford | E21B 10/32 |
| 9,593,538 | B2 * | 3/2017 | Rasheed | E21B 10/32 |
| 2001/0020552 | A1 | 9/2001 | Beaton et al. | |
| 2003/0029644 | A1 | 2/2003 | Hoffmaster et al. | |
| 2003/0155155 | A1 * | 8/2003 | Dewey | E21B 7/067 175/57 |
| 2004/0188149 | A1 | 9/2004 | Thigpen et al. | |
| 2004/0222022 | A1 * | 11/2004 | Nevlud | E21B 10/322 175/57 |
| 2005/0034897 | A1 | 2/2005 | Youan | |
| 2007/0089912 | A1 | 4/2007 | Eddison et al. | |
| 2007/0163808 | A1 | 7/2007 | Campbell | |
| 2007/0205024 | A1 | 9/2007 | Mensa-Wilmot | |
| 2008/0149396 | A1 | 6/2008 | Fyfe | |
| 2008/0190670 | A1 | 8/2008 | Welch et al. | |
| 2008/0314645 | A1 | 12/2008 | Hall et al. | |
| 2009/0294178 | A1 * | 12/2009 | Radford | E21B 10/322 175/57 |
| 2009/0321138 | A1 | 12/2009 | Shamburger et al. | |
| 2010/0012387 | A1 | 1/2010 | Huynh et al. | |
| 2010/0018779 | A1 | 1/2010 | Makkar et al. | |
| 2010/0051349 | A1 | 3/2010 | Ballard et al. | |
| 2010/0089649 | A1 | 4/2010 | Welch et al. | |
| 2010/0263875 | A1 | 10/2010 | Williams et al. | |
| 2010/0276201 | A1 | 11/2010 | Makkar et al. | |
| 2011/0005836 | A1 | 1/2011 | Radford et al. | |
| 2011/0005841 | A1 | 1/2011 | Wood et al. | |
| 2011/0120777 | A1 | 5/2011 | Lee | |
| 2011/0127087 | A1 | 6/2011 | Hareland | |
| 2011/0259650 | A1 | 10/2011 | Hall et al. | |
| 2012/0012398 | A1 | 1/2012 | Hall et al. | |
| 2012/0152543 | A1 | 6/2012 | Davis | |
| 2012/0205151 | A1 | 8/2012 | Inoue et al. | |
| 2012/0205157 | A1 | 8/2012 | Radford et al. | |
| 2012/0255786 | A1 | 10/2012 | Isenhour | |
| 2013/0075167 | A1 | 3/2013 | Knull et al. | |
| 2013/0087386 | A1 | 4/2013 | Radford et al. | |
| 2013/0146361 | A1 * | 6/2013 | Makkar | E21B 10/322 175/57 |
| 2013/0199855 | A1 | 8/2013 | Shears | |
| 2013/0256036 | A1 | 10/2013 | Lyons | |
| 2013/0341100 | A1 | 12/2013 | Zhang et al. | |
| 2014/0008128 | A1 | 1/2014 | Adam | |
| 2014/0048335 | A1 | 2/2014 | Mensa-Wilmot | |
| 2014/0048336 | A1 | 2/2014 | Mensa-Wilmot | |
| 2014/0262523 | A1 | 9/2014 | Davis | |
| 2015/0068813 | A1 | 3/2015 | Moreno et al. | |
| 2015/0144405 | A1 | 5/2015 | Salvo et al. | |
| 2016/0290067 | A1 | 10/2016 | Tipples et al. | |
| 2016/0305190 | A1 * | 10/2016 | Johnson | E21B 10/32 |
| 2017/0058611 | A1 | 3/2017 | Lin, Jr. et al. | |
| 2017/0204670 | A1 | 7/2017 | Hird et al. | |
| 2017/0211332 | A1 | 7/2017 | Hird et al. | |
| 2017/0211333 | A1 | 7/2017 | Hird et al. | |
| 2017/0211334 | A1 | 7/2017 | Hird et al. | |
| 2017/0211335 | A1 * | 7/2017 | Hird | E21B 10/322 |
| 2017/0218707 | A1 | 8/2017 | Hird et al. | |
| 2018/0094496 | A1 | 4/2018 | Su et al. | |

FOREIGN PATENT DOCUMENTS

| | | | |
|---|---|---|---|
| EP | 0397417 | A1 | 11/1990 |
| EP | 0869256 | A2 | 10/1998 |
| EP | 1811124 | A1 | 7/2007 |
| EP | 2097610 | B1 | 6/2011 |
| GB | 2417267 | A | 2/2006 |
| GB | 2520998 | A | 6/2015 |
| WO | 9937881 | A3 | 7/1999 |
| WO | 03102354 | A1 | 12/2003 |
| WO | 2004101943 | A2 | 11/2004 |
| WO | 2005047644 | A1 | 5/2005 |
| WO | 2005052301 | A2 | 6/2005 |
| WO | 2007041811 | A1 | 4/2007 |
| WO | 2008100194 | A2 | 8/2008 |
| WO | 2010126938 | A2 | 11/2010 |
| WO | 2013134629 | A1 | 9/2013 |
| WO | 2013167954 | A2 | 11/2013 |
| WO | 2014028457 | A1 | 2/2014 |
| WO | 2014150524 | A2 | 9/2014 |
| WO | 2014159079 | A1 | 10/2014 |
| WO | 2015054227 | A2 | 4/2015 |

OTHER PUBLICATIONS

Combined Search and Exam Report of United Kingdom Patent Application No. 1321625.4 dated May 7, 2014, 3 pages.

Search Report of European Patent Application No. 14868423.6 dated Nov. 23, 2016, 4 pages.

Exam Report of European Patent Application No. 14868423.6 dated Jan. 3, 2017, 5 pages.

Search Report under Section 17 issued in U.K. Patent Application No. 1412934.0, dated Jan. 16, 2015, 4 pages.

Exam Report under Section 18(3) issued in U.K. Patent Application No. 1412934.0, dated Sep. 2, 2016, 2 pages.

Search Report and Written Opinion issued in International Patent Application No. PCT/US2015/041224, dated Oct. 8, 2015, 11 pages.

Office Action issued in U.S. Appl. No. 15/328,051, dated Aug. 24, 2018, 22 pages.

Search Report and Written Opinion issued in International Patent Application No. PCT/US2015/041260, dated Oct. 19, 2015, 12 pages.

Search Report under Section 17(5) issued in U.K. Patent Application No. 1412933.2, dated Dec. 22, 2014, 4 pages.

Search Report under Section 17(5) issued in U.K. Patent Application No. 1412932.4, dated Jan. 16, 2015, 3 pages.

Exam Report under Section 18(3) issued in U.K. Patent Application No. 1412932.4, dated Jan. 23, 2018, 4 pages.

Exam Report under Section 18(3) issued in U.K. Patent Application No. 1412932.4, dated Nov. 18, 2016, 5 pages.

Search Report and Written Opinion issued in International Patent Application No. PCT/US2015/041265, dated Oct. 8, 2015, 12 pages.

(56) References Cited

OTHER PUBLICATIONS

Search Report and Written Opinion issued in International Patent Application No. PCT/US2015/041223, dated Oct. 19, 2015, 11 pages.
Search Report under Section 17(5) issued in U.K. Patent Application No. 1412929.0, dated Jan. 12, 2015, 3 pages.
Combined Search and Exam Report under Sections 17 and 18(3) issued in U.K. Patent Application No. 1509434.5, dated Nov. 25, 2015, 8 pages.
Search Report and Written Opinion issued in International Patent Application No. PCT/US2015/041280, dated Oct. 13, 2015, 12 pages.
Combined Search and Exam Report under Sections 17 and 18(3) issued in U.K. Patent Application No. 1412930.8, dated Jan. 12, 2015, 5 pages.
Search Report and Written Opinion issued in International Patent Application No. PCT/US2015/040295, dated Oct. 12, 2015, 12 pages.
Exam Report under Article 94(3) issued in European Patent Application No. 14868423.6 dated Nov. 14, 2018, 5 pages.

* cited by examiner

EXPANDABLE REAMER

BACKGROUND

One practice which may be employed when drilling a borehole is to enlarge a hole with an expandable reamer. This may be done as a separate operation to enlarge an existing borehole drilled at an earlier time, or it may be done when using a bottom hole assembly which has a drill bit at its bottom end and an expandable reamer positioned at some distance above the drill bit.

When a bottom hole assembly contains both a drill bit and a reamer, the drill bit makes an initial hole, sometimes referred to as pilot hole. It is normal that a drill bit has so-called gauge pads (alternatively spelt "gage pads") on a part of the drill bit above the cutters. These pads are positioned so that they present faces confronting the wall of the drilled hole at the same radial distance from the drill bit axis as the radial extremity of the cutters, so that these pads can press on the wall of the newly drilled pilot hole but without enlarging it because they do not have cutting surfaces. The purpose of these pads is to position the drill bit in the newly drilled hole.

The purpose of the reamer (which is higher up in the assembly) is to enlarge the diameter of the pilot hole which has already been drilled. An expandable reamer makes it possible to insert the reamer into a hole with a diameter which is less than the expanded diameter of the reamer and then expand the reamer at a desired depth so as to commence a section of borehole which is reamed out to a larger diameter than the pilot hole and possibly also larger than the hole above the reamer. Both the drill bit and the reamer may consist of supporting structure with hard-surfaced cutters attached to the supporting structure.

Another frequent use of an expandable reamer is to enlarge the diameter of an existing borehole. For this the expandable reamer may be used in an assembly without a drill bit because the purpose is to enlarge but not extend the existing hole.

There is more than one type of reaming tool. Some reamers are constructed to be eccentric, relative to the drill string to which they are attached and the borehole which they are enlarging. Other reamers are constructed to remain concentric with the drill string and the borehole. These different types of reamers tend to be used in different circumstances. There are many instances where concentric reamers are the appropriate choice.

An expandable reaming tool is normally made with plurality of radially expandable support elements for cutters arranged around the axis of the tool. Often the tool has three such cutter support elements which extend axially along the tool and are arranged at 120° intervals azimuthally around the tool axis. A mechanism is provided for expanding these support elements radially outwardly from the axis and this mechanism typically uses hydraulic pressure to force the cutter support elements outwardly.

This tool construction has commonly been used for concentric reamers. In some constructions, each of the individual cutter support structures arranged around the tool axis is an assembly of parts attached together so as to move bodily as one piece, in which case the assembly is often referred to as a "block" (one part of this assembly may be a shaped block) although the term "arm" has also been used for such a block. The individual support structures (i.e. individual blocks) may be moved outwards in unison by one drive mechanism acting on them all, or may be moved outwards by drive mechanism(s) which does not constrain them to move in unison.

U.S. Pat. No. 7,975,783 shows a different construction in which each of the cutter support elements arranged around the axis of the tool has two parts which are pivotally connected, and expansion causes outward movement of the pivot.

When the reamer, with its cutter support elements retracted, is in position at the required depth, the drill string is rotated for a period of time at approximately constant depth while the reamer is expanded. There is not normally any communication from the reamer to the surface to confirm that its cutter support elements have fully expanded, but an indication of expansion of the reamer may come from observing the torque on the drill string. Once it is believed that the reamer is fully expanded, the drill string and bottom hole assembly are advanced axially so that the expanded reamer travels axially, cutting as it goes and enlarging the diameter of a length of the borehole.

It will be appreciated that whilst the reamer is being expanded its cutters are required to cut radially outwardly from the axis of the borehole but once the reamer has been expanded and the drill string and bottom hole assembly are being advanced axially, the reamer is cutting in an axial direction.

It is normal practice that the cutter support elements of an expandable reamer are provided with stabilising pads which have faces positioned to confront the wall of the borehole and press on the newly-reamed borehole wall. The purpose of these stabilising pads is to position the axially advancing reamer in the hole in a manner analogous to the gauge pads on a drill bit keeping the bit positioned in a pilot hole. However, there is an inherent conflict of functions. The pads are intended to press on the wall while the reamer is being advanced axially, but they also press against the wall of the borehole whilst the reamer is being expanded and in consequence the pads oppose the expansion of the reamer's cutter support elements.

A customary approach has been to make the stabilising pads slightly under-gauge, that is to say they are positioned at a radial distance from the central axis of the reamer which is slightly less (perhaps by only 1 mm) than the radial distance from that axis to the extremity of the cutters, the outermost of which define the gauge radius of the reamer. Consequently, the outermost cutters project radially slightly beyond the stabilising pads and it is found that the reamer can cut radially outwards as it is being expanded. The process by which a reamer with under-gauge stabilising pads cuts radially outwardly as it is being expanded is not clear. Even though under-gauge, the pads would be expected to oppose expansion and it may be necessary to provide some axial movement of the reamer in the borehole, perhaps by moving the drill string up and down slightly, or advancing it slowly. When the fully expanded reamer is advanced axially, these stabilising pads will engage the wall of the borehole sufficiently to keep the reamer in position, even though the pads are under gauge. If a reamer does not have these stabilising pads, its position in the borehole is much less stable.

A number of prior documents make proposals for stabilization of reamers, for instance by placing a stabilizer in the drill string close to the reamer as in U.S. Pat. Nos. 8,205,689 and 8,297,381. U.S. Pat. No. 8,550,188 describes a reamer in which the cutter support elements are distributed asymmetrically around the tool axis as a way to enhance stability. In contrast, U.S. Pat. No. 7,954,564 seeks to enhance stability by decreasing imbalance force during longitudinal drilling. This is done partly through the arrangement of cutters on the support elements and partly through elongating the stabilising pads to 30 to 45% of the total length of a cutter support element.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

We have now found that under-gauge stabilising pads allow or cause vibration and instability of a reamer. We believe that such vibration may assist the initial expansion of reamers provided with under-gauge pads but we have found that it is detrimental when the reamer is advanced axially. We have found that this vibration can be considerably reduced by a departure from the customary constructional arrangement.

One aspect of the disclosed subject matter of this application is an expandable reaming tool comprising:

a plurality of support elements for cutters and/or stabilising pads distributed around a central axis of the tool; and means for expanding the support elements radially outwardly from the central axis;

wherein the support elements differ in the cutting regions and stabilising pads thereon such that at least one of the support elements comprises a cutting region comprising cutters and at least one support element comprises a stabilising pad and the difference between at least one support element an another support element is in the presence or axial position of at least one stabilising pad thereon.

This arrangement in which the presence and/or axial locations of stabilising pads differs between the support elements may be such that the axial length along the tool occupied by each stabilising pad on any one element is at least partially occupied by one or more cutting regions on one or more other support elements. Possibly at least 75% of, or at least 90% of, or possibly the whole of the axial length along the tool occupied by each stabilising pad on any one element is occupied by one or more cutting regions of one or more other support elements.

The cutters in a cutting region may be attached to a part of the support element which faces the borehole wall. The cutters may be arranged in rows and project from the support element outwardly from it in a direction which is radially outwards from the tool axis. A stabilising pad on a support element may have a substantially smooth front surface without cutters attached to it, positioned to face the borehole wall and make sliding contact with the wall. This front surface may be part cylindrical with a radius which is the same as, or possibly slightly less than, the gauge radius from the tool axis to the extremity of the cutters when the support elements are fully expanded.

A support element on an expandable reamer may include a cutting region which extends axially but is inclined relative to the tool axis so that the radial distance from the axis increases along the axial length of such a cutting region. Cutters in such a region serve to enlarge the borehole as the reamer is advanced axially. Stabilising pads may then be provided on an adjacent region which extends generally parallel to the tool axis. The plurality of support elements of a reaming tool as disclosed here may all have similar inclined cutting regions, but differ in the presence or position of stabilising pads within an axial extent adjacent to the inclined cutting regions.

When a reamer is rotated with its cutter support elements expanded, a notional surface is swept out by the radially outer parts of the pads and cutters. The consequence of the arrangements disclosed here is that within this notional surface the axial portion which is swept out exclusively by stabilising pads is smaller than with a conventional reamer in which the stabilising pads are all at the same axial position on each support element. As a result, when the reamer is being expanded, the blades can cut radially outwards, even if the stabilising pads are at or close to full gauge, because the axial length of borehole which is in contact solely with these pads is reduced. In some embodiments, none of the notional surface swept out by pads and cutters is swept out exclusively by the stabilising pads.

There are several possibilities within the general arrangement above. One possibility is that every one of a plurality of cutter support elements has at least one cutting region and at least one stabilising pad and the axial locations of the stabilising pads differ between the support elements. Another possibility is that there is at least one cutter support element which does not include a stabilising pad and/or a stabilising pad is provided on only one of a plurality of support elements.

In some embodiments the stabilising pads are at full gauge so that the radial distance from the tool axis to the outermost extent of the pads is the same (within a manufacturing tolerance which may be no more than 0.2 mm) as the radial distance from the tool axis to the radially outer extremity of the cutters.

It is also possible that the stabilising pads could be dimensioned to be under-gauge, perhaps by a smaller amount than is customary. The pads might for example be under-gauge by an amount which is less than 0.5 mm such as between 0.2 mm and 0.4 mm or by an even smaller amount such as less than 0.2 mm.

When fully expanded, the support elements may all extend an equal amount from the tool axis. In some forms of the reamer disclosed here, the means for expanding the support elements comprises a drive mechanism acting on all the support elements simultaneously to move them outwardly together. This drive mechanism may move them in unison and may move them by an equal extent radially, so that while it is expanding the reamer remains concentric with the tool string to which it is attached. It is also possible that the support elements are not constrained to move in unison even though they are being driven outwardly towards fully expanded positions at which they each extend an equal distance from the tool axis.

Also disclosed here is a method of enlarging a borehole by expanding a reaming tool as above within the borehole and moving the tool axially along the borehole while rotating it. Within the broad scope of such a method is a method of drilling a borehole with a drilling assembly comprising a drill bit and a reamer as specified above spaced from the drill bit by at least 5 meters, possibly at least 10 or even at least 20 meters, rotating and advancing the drill bit to extend a pilot hole and simultaneously rotating and advancing the reamer to enlarge the pilot hole.

DETAILED DESCRIPTION

Figure 1:
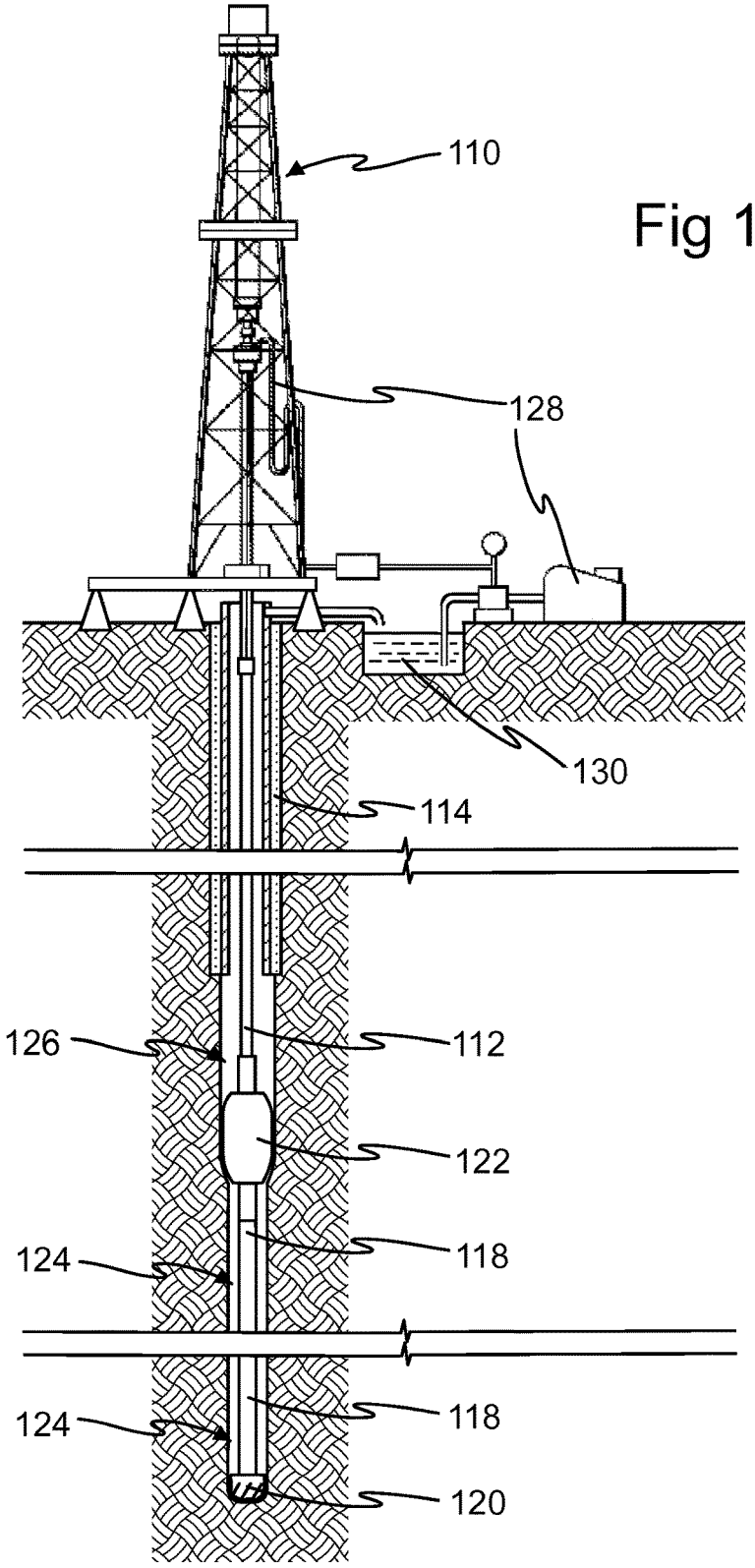
FIG. 1 is a schematic, cross-sectional view of a drilling assembly in a borehole.

FIG. 1 shows an exemplary drilling assembly which includes an expandable under-reamer 122. A drill string 112 extends from a drilling rig 110 into a borehole. An upper part of the borehole has already been lined with casing and cemented as indicated at 114. The drill string 112 is connected to a bottomhole assembly 118 which includes a drill bit 120 and an under-reamer 122 which has been expanded beneath the cased section 114. As the drill string 112 and bottomhole assembly 114 are rotated, the drill bit 120 extends a pilot hole 124 downwards while the reamer 122 simultaneously opens the pilot hole 124 to a larger diameter borehole 126.

The drilling rig is provided with a system 128 for pumping drilling fluid from a supply 130 down the drill string 112 to the reamer 122 and the drill bit 120. Some of this drilling fluid flows through passages in the reamer 122 and flows back up the annulus around the drill string 112 to the surface. The rest of the drilling fluid flows out through passages in the drill bit 120 and also flows back up the annulus around the drill string 112 to the surface.

As shown, the distance between the reamer 122 and the drillbit 120 at the foot of the bottom hole assembly is fixed so that the pilot hole 124 and the enlarged borehole 126 are extended downwardly simultaneously. It would be possible to use the same reamer 122 attached to drillstring 112 (but without the drill bit 120 and the part of the bottom hole assembly 118 below the reamer 122) in similar manner to enlarge an existing borehole.

Figure 2:
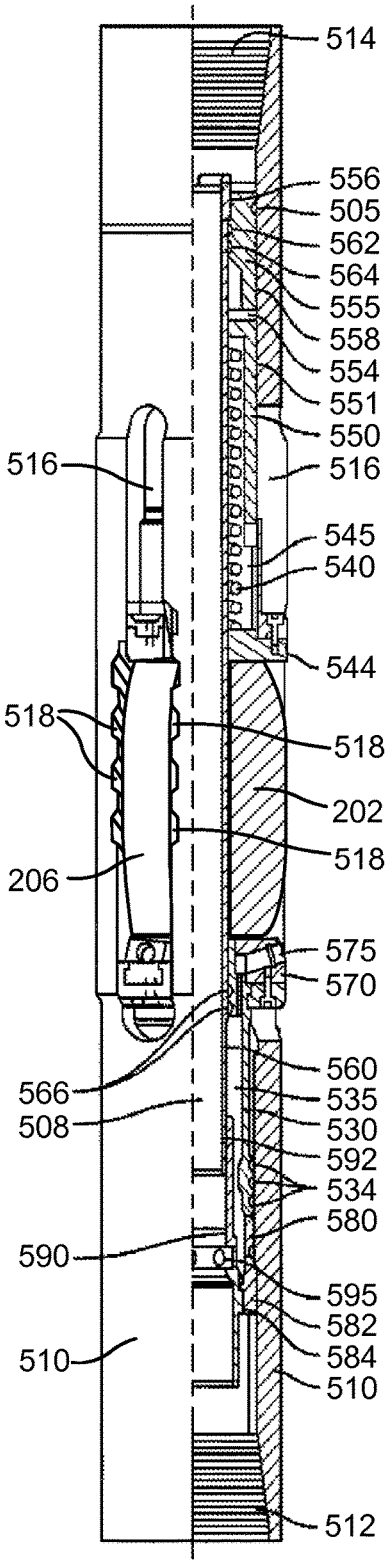
FIG. 2 is a cross-sectional elevation view of one embodiment of expandable reamer, showing its expandable blades in collapsed position.
Figure 3:
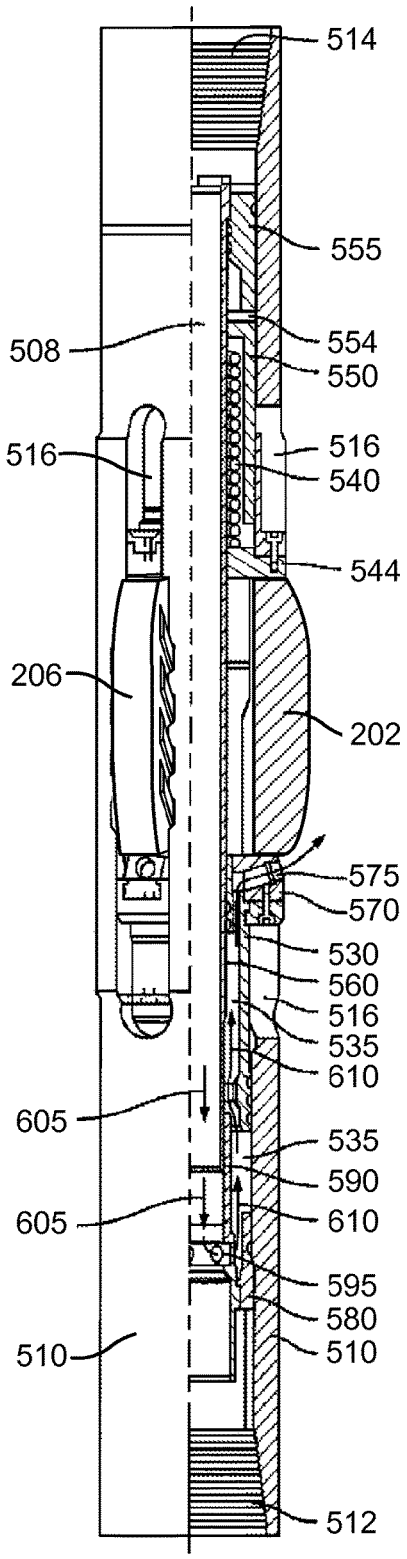
FIG. 3 is a cross-sectional elevation view of the expandable reamer of FIG. 2, showing the blades in expanded position.

Referring now to FIGS. 2 and 3, one embodiment of expandable reaming tool is shown in a collapsed position in FIG. 2 and in an expanded position in FIG. 3. The expandable tool comprises a generally cylindrical tool body 510 with a central flowbore 508 for drilling fluid. The tool body 510 includes upper 514 and lower 512 connection portions for connecting the tool into a drilling assembly. Intermediately between these connection portions 512, 514 there are three recesses 516 are formed in the body 510 and spaced apart at 120° intervals azimuthally around the axis of the tool.

Each recess 516 accommodates a cutter support element 202 in its collapsed position. This support element has the general form of a block to which cutters are attached. One such cutting block 202 is shown in perspective in FIG. 4 with a side elevation shown in FIG. 7. The block 202 has a face which confronts the wall of the borehole and side faces with protruding ribs 204 which extend at an angle to the tool axis. These ribs 204 engage in channels 518 at the sides of a recess 516 and thus provide a guide mechanism such that when the block 202 is pushed upwardly relative to the tool body 510, it also moves radially outwardly to the position shown in FIG. 3 in which the blocks 202 extend radially outwardly from the tool body 510. Details of the outer face 206 of a block 202 have been omitted from FIGS. 2 and 3 but will be described below with reference to FIG. 4 onwards.

A spring 540 biases the block 202 downwards to the collapsed position of FIG. 2. The biasing spring 540 is disposed within a spring cavity 545 and covered by a spring retainer 550 which is locked in position by an upper cap 555. A stop ring 544 is provided at the lower end of spring 540 to keep the spring in position.

Below the moveable blocks 202, a drive ring 570 is provided that includes one or more nozzles 575. An actuating piston 530 that forms a piston cavity 535 is attached to the drive ring 570. The piston 530 is able to move axially within the tool. An inner mandrel 560 is the innermost component within the tool 500, and it slidingly engages a lower retainer 590 at 592. The lower retainer 590 includes ports 595 that allow drilling fluid to flow from the flowbore 508 into the piston chamber 535 to actuate the piston 530.

The piston 530 sealingly engages the inner mandrel 560 at 566, and sealingly engages the body 510 at 534. A lower cap 580 provides a stop for the downward axial movement of piston 530. This cap 580 is threadedly connected to the body 510 and to the lower retainer 590 at 582, 584, respectively. Sealing engagement is provided at 586 between the lower cap 580 and the body 510.

A threaded connection is provided at 556 between the upper cap 555 and the inner mandrel 560 and at 558 between the upper cap 555 and body 510. The upper cap 555 sealingly engages the body 510 at 505, and sealingly engages the inner mandrel 560 at 562 and 564.

In operation, drilling fluid flows along path 605, through ports 595 in the lower retainer 590 and along path 610 into the piston chamber 535. The differential pressure between the fluid in the flowbore 508 and the fluid in the borehole annulus surrounding tool 500 causes the piston 530 to move axially upwardly from the position shown in FIG. 2 to the position shown in FIG. 3. A small amount of flow can pass through the piston chamber 535 and through nozzles 575 to the annulus as the tool 500 starts to expand. As the piston 530 moves axially upwardly, it urges the drive ring 570 axially upwardly against the blocks 202. The drive ring pushes on all the blocks 202 simultaneously and moves them all axially upwardly in recesses 516 and also radially outwardly as the ribs 150 slide in the channels 518. The blocks 202 are thus driven upwardly and outwardly in unison towards the expanded position shown in FIG. 3.

The movement of the blocks 202 is eventually limited by contact with the spring retainer 550. When the spring 540 is fully compressed against the retainer 550, it acts as a stop and the blocks can travel no further. There is provision for adjustment of the maximum travel of the blocks 202. The spring retainer 550 connects to the body 510 via a screwthread at 551. A wrench slot 554 is provided between the upper cap 555 and the spring retainer 550, which provides room for a wrench to be inserted to adjust the position of the screwthreaded spring retainer 550 in the body 510. This allows the maximum expanded diameter of the reamer to be set at the surface. The upper cap 555 is also a screwthreaded component and it is used to lock the spring retainer 550 once it has been positioned.

Figure 4:
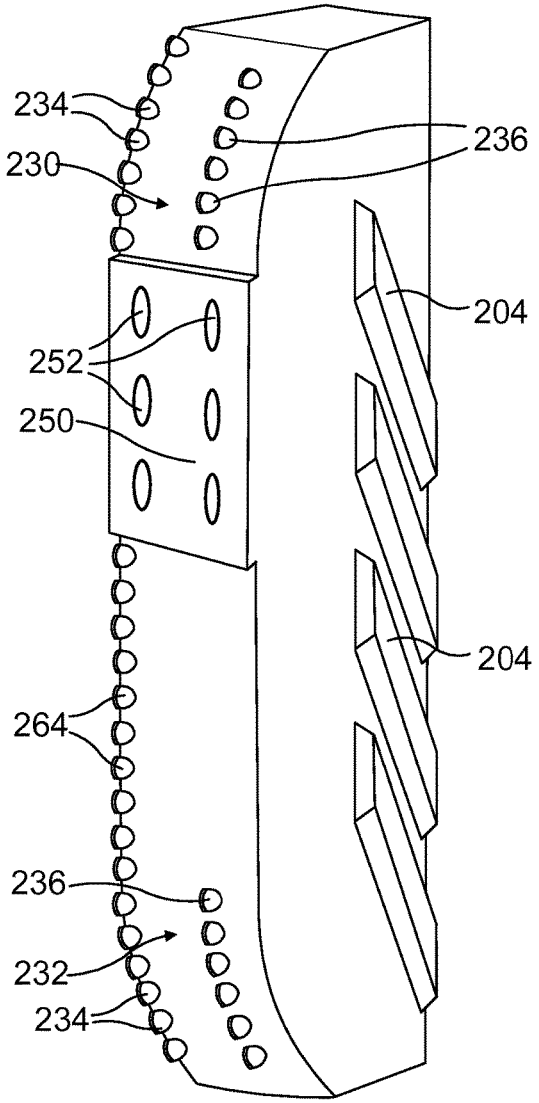
FIG. 4 is a perspective view of a cutter block for the expandable reamer of FIGS. 2 and 3.
Figure 5:
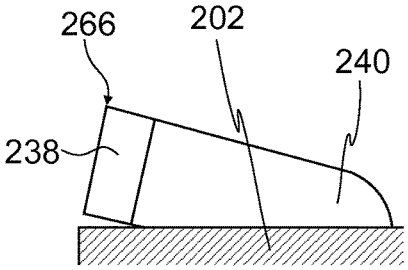
FIG. 5 is a detail view of a cutter.
Figure 7:
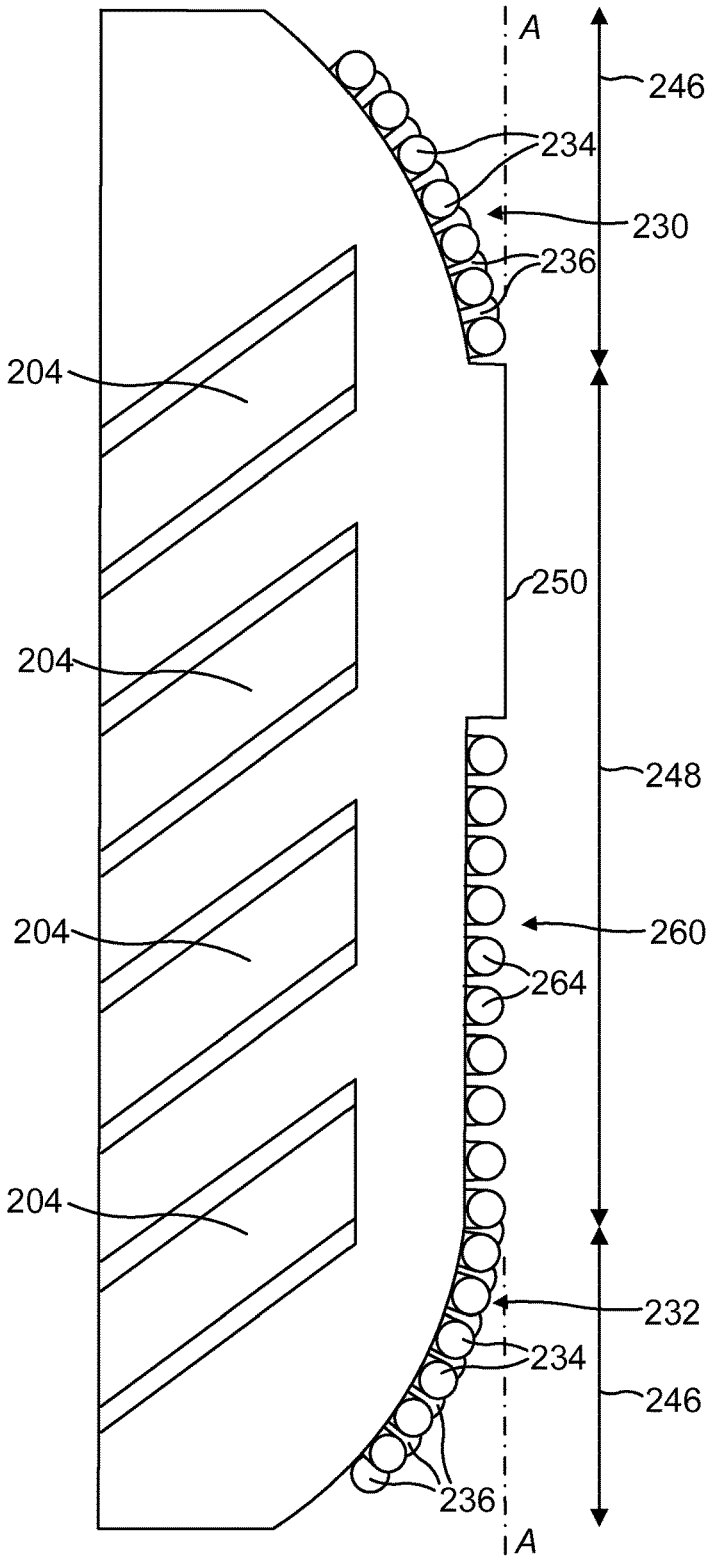
FIG. 7 is a side elevation view of the cutter block of FIG. 4.

FIG. 4 is a perspective view of a cutter block 202 and FIG. 7 is a side elevation of the same block. This block 202 has upper and lower cutting regions 230, 232 on which hard surfaced cutters 234, 236 are mounted. These cutters may be polycrystalline diamond (PDC cutters) as shown in FIG. 5 with a sintered disc 238 of diamond crystals embedded in a binder material at one end of a cylindrical body 240 which may be a sintered mass of tungsten carbide particles and a binder material. The body 240 is secured by brazing to support structure which is part of the block 202. As shown in FIG. 5 the hard face 238 projects from the support provided by block 202.

The cutters in each cutting region 230, 232 are arranged in a leading row of cutters 234 and a following row of cutters 236. As best seen from FIG. 7, the attachment of the cutters to the block 202 leaves gaps between adjacent cutters. The cutters 236 in the following row are therefore positioned to face the gaps between the cutters 234 in the leading row. For the sake of simplicity, FIG. 4 does not show conventional details in the construction of block 202, but the cutters 234 in the leading row may be brazed to a steel support which is an intermediate component bolted to the main structure of the cutting block 202. Similarly the row of cutters 236 may be brazed to a second steel support which is also bolted to the main structure of the block 202.

The inclined cutting regions 230, 232 lie within axial extents of the block 202 which are indicated 246 in FIG. 7. Between these regions there is an axially middle section indicated 248 in FIG. 7 which includes a stabilising pad 250. This stabilising pad does not include cutters but has a generally smooth front surface positioned to face and slide over the borehole wall. To increase resistance to wear, the stabilising pad 250 may have pieces 252 of hard material 252 such as sintered tungsten carbide embedded in it and flush with its front surface. The front surface of the pad 250, facing the borehole wall is here a part-cylindrical surface with axis parallel to the tool axis and radius equal to the gauge radius of the fully expanded tool.

The cutter block 202 projects radially outwards from the central axis of the tool. It will be appreciated that the upper and lower cutting regions 230, 232 are inclined relative to the tool axis (they are curved as shown) so that projection outwards from the tool axis is least at the top and bottom ends of the block 202 and greatest adjacent the middle section 248 which includes stabilising pad 250.

Figure 6:
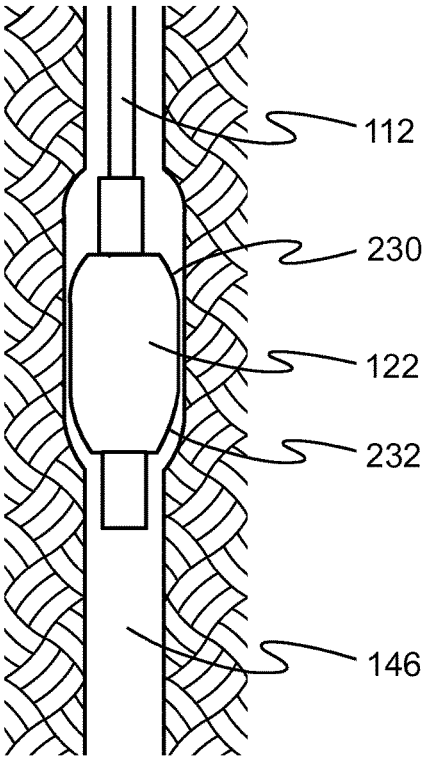
FIG. 6 is a schematic, cross-sectional view of the reamer expanded in a borehole.

When a reamer is advanced downwardly within a hole to enlarge the hole, it is the curved lower cutting regions 232 which do the work of cutting through formation rock. This takes place in FIG. 1, as the drill string is advanced. FIG. 6 schematically shows a reamer 122 which is about to be used to enlarge an existing borehole 146 which had been drilled at an earlier time. Because this operation is widening an existing borehole the reamer 122 is attached to a drill string 112 similar to the arrangement in FIG. 1, but without a drill bit below it. Expansion of the reamer has created a fairly short portion of enlarged diameter. This enlarged portion of the borehole can then be elongated downwardly by advancing the drill string 112 and reamer 122 downwardly. The enlarged portion can also be extended upwardly using the cutting regions 230 on the blocks 202 to remove formation rock while pulling upwardly on the drill string 112.

In a conventional reamer, the three cutting blocks may be identical to each other or may be similar in size and shape with some variation in the positions of cutters on the blocks. However, the reamer shown here has cutting blocks 202 which differ one from another in the axial positioning of stabilising pads. These cutting blocks are shown in side elevation in FIGS. 7, 8 and 9. It can be seen that all three cutting blocks have a general structure, including ribs 204, which is of similar size and shape. All three blocks 202 have the same axial length and the same upper and lower curved cutting regions 230, 232. All three blocks 202 have stabilising pads at the same radial distance from the tool axis. However, the axial positioning of the stabilising pads 250 within the axially middle sections 248 of the blocks differs and associated with this there are differences in the cutting regions in the middle sections 248.

The cutting block shown in FIG. 7 has its stabilising pad 250 positioned at the top of the middle section 248 of the block. The block shown in FIG. 9 has its stabilising pad 250 at the bottom of the middle section 248 of the block while the block 202 of FIG. 8 has its stabilising pad 250 approximately halfway between the top and bottom of the middle section 248 of the block. The middle sections of the blocks 202 shown in FIG. 7 and in FIG. 9 each include a cutting region 260 in which there is a single row of cutters all at the same radial distance from the tool axis. Within this section 260 the outer extremities (indicated 266 in FIG. 5) of the cutters 264 are at the maximum radial distance from the tool axis and this is the gauge radius of the tool when it is fully expanded. The extremities of these cutters lie on a line A-A indicated chain dotted which is at least approximately aligned with the surface of the stabilising pad 250. In the case of the block shown in FIG. 8, the middle section 248 of the block includes two such cutting regions 260.

Figure 10:
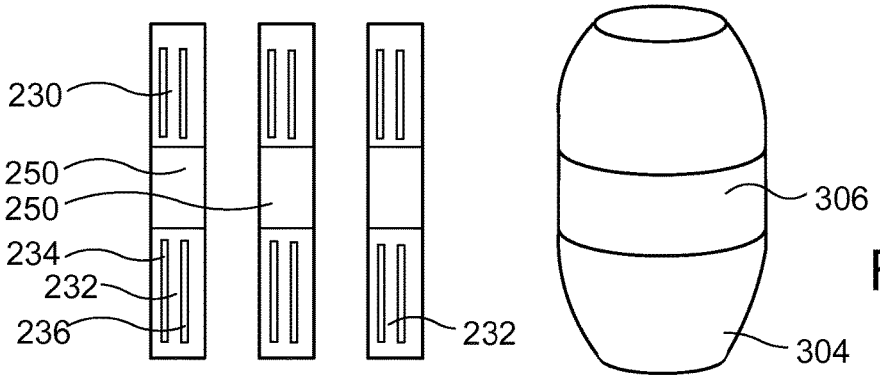
FIG. 10 diagrammatically illustrates the set of cutter blocks of a conventional reamer.
Figure 11:
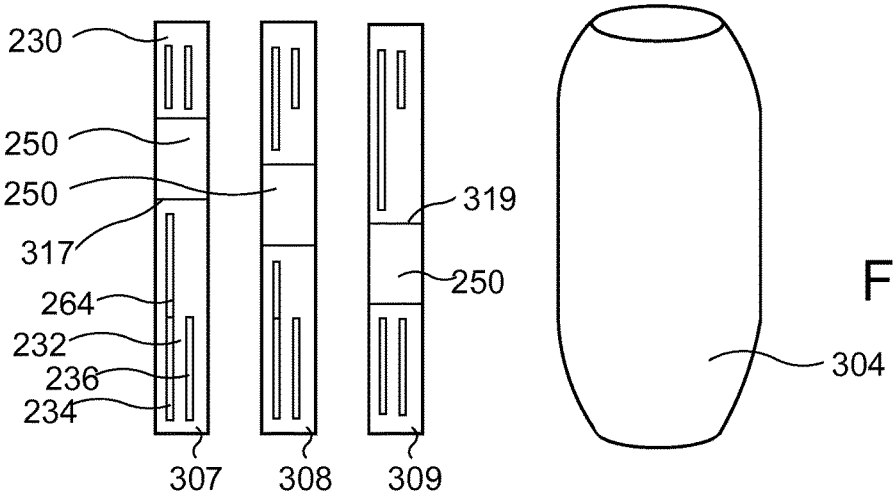
FIG. 11 diagrammatically illustrates the set of cutter blocks shown by FIGS. 7 to 9.

The consequence of this arrangement, in which the stabilising pads 250 are at different axial positions along the length of the cutter blocks is illustrated by comparison of FIGS. 10 and 11.

FIG. 10 diagrammatically shows the outer faces of three cutter blocks which are identical, as in a conventional reamer. Of course the three blocks would be positioned at 120° intervals around the reamer axis, but in this diagram they are shown side-by-side. The barrel-shaped notional surface 304 swept out by the cutter blocks as the reamer rotates includes a band 306 which is swept out exclusively by stabilising pads 250. In consequence, when it is intended to expand the blocks, their expansion is blocked by the smooth faces of the stabilising pads 250 pressing against the wall of the borehole without cutting into it. Omitting the stabilising pads 250 is not a viable option. Without them the reamer is not kept in position in the borehole and may enlarge a cylindrical borehole to much greater diameter than intended. As already mentioned, in order to allow expansion whilst also having stabilising pads present, the conventional approach has been to position the stabilising pads 250 so that their outer faces are at a radial distance from the tool axis which is slightly less than the outermost extremities of the cutters 234, 236 in the cutting regions. In other words, the cutters extend to full gauge but the stabilising pads are slightly under gauge.

Figure 8:
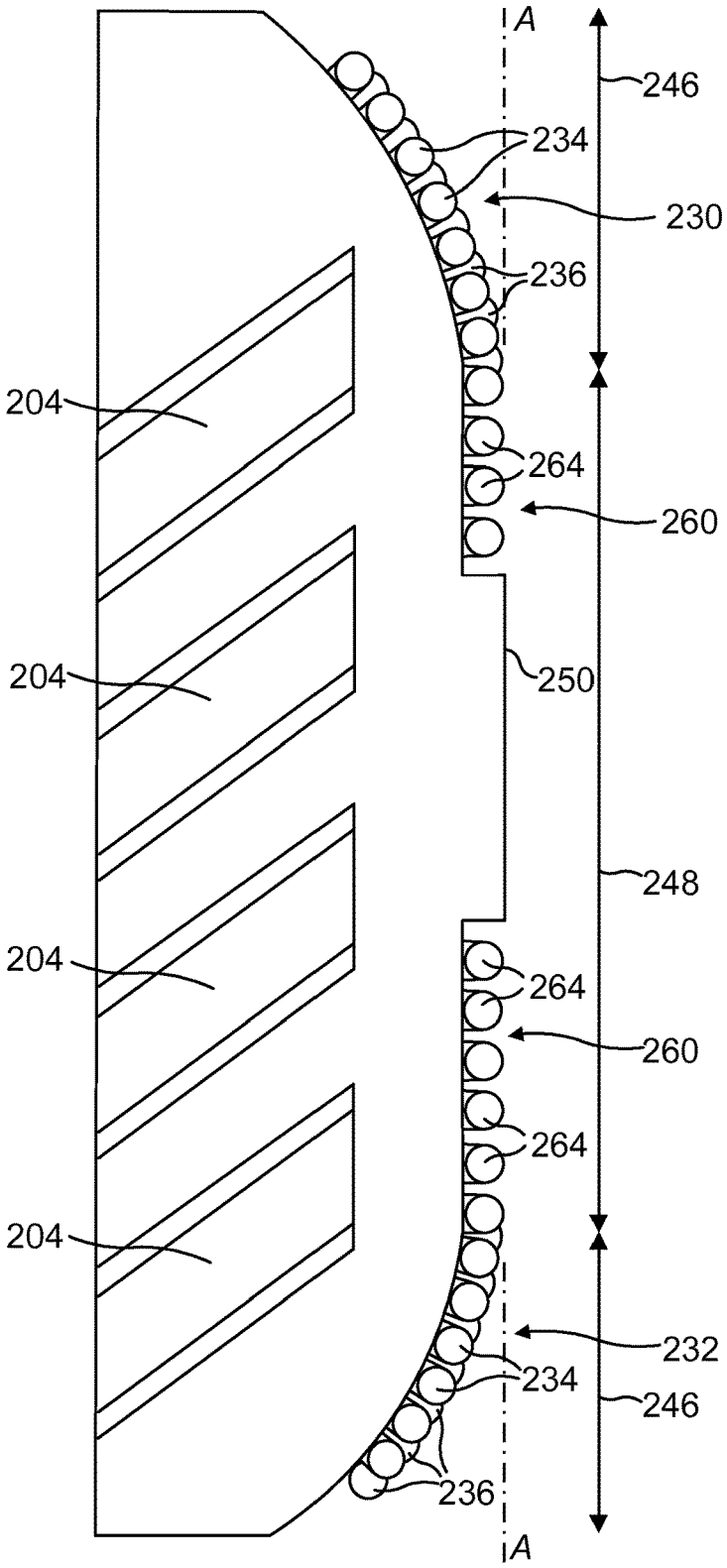
FIGS. 8 and 9 are side elevation views of two more cutter blocks.
Figure 9:
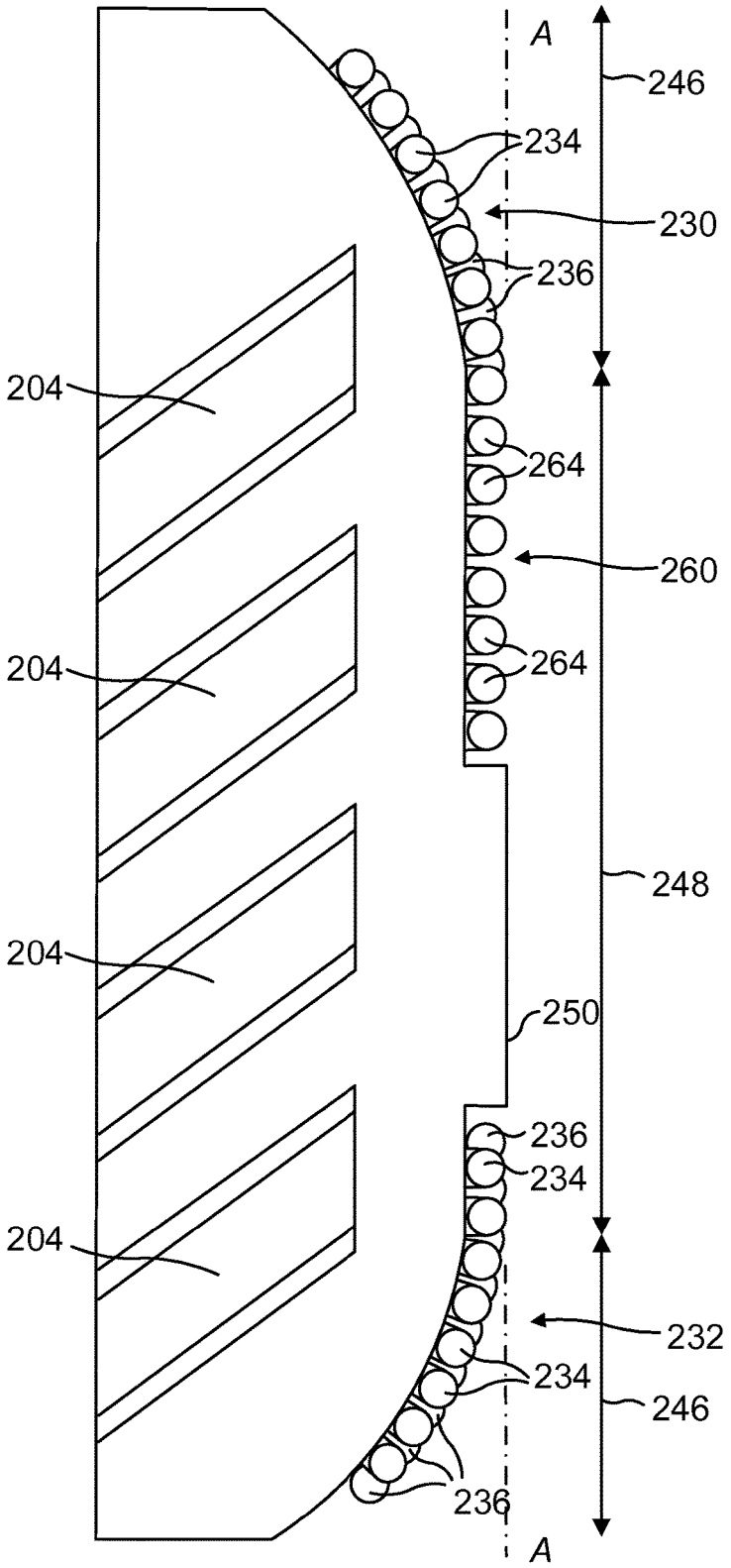

FIG. 11 is a similar diagram which shows the outer faces of the cutter blocks seen in FIGS. 7, 8 and 9. They are indicated in this diagram as 307, 308 and 309. The stabilising pads 250 are at different positions axially along the length of the blocks as already shown by FIGS. 7, 8 and 9. The lower edge 317 of stabilising pad 250 of block 307 is above the upper edge 319 of the stabilising pad 250 of block 309. The axial extent of the stabilising pad 250 on block 307 coincides with part of the cutting region 260 of block 309 while the stabilising pad 250 of block 309 coincides axially with part of the cutting region 260 of block 307. Consequently, the barrel shaped notional surface 304 swept by the cutter blocks 307, 308 and 309 as they rotate has no portion at all which is swept out exclusively by stabilising pads.

With this geometry, shown by FIGS. 7, 8, 9 and 11, the cutters' outer extremities 266 lying on line A-A may be made to align with the surface of the stabilising pads 250 so that both the cutters and the stabilising pads are at full gauge. Because the stabilising pads are at different axial positions on different blocks 202, it is possible to expand the cutting blocks when required, even though none of the cutters 234, 236 projects beyond stabilising pads 250.

Another possibility is to position the stabilising pads 250 under gauge, as is conventional. However because there is no region of the borehole wall contacted exclusively by stabilising pads while the reamer is being expanded, expansion will take place more rapidly than with a conventional reamer as in FIG. 10. A further possibility is to position the stabilising pads under gauge by a smaller amount than is customary. With such an arrangement vibration will be reduced because the stabilising pads are close to full gauge but expansion will still be accomplished in an acceptably short time.

In a variation of the arrangement of FIGS. 7, 8, 9 and 11 the axially middle section 248 of the block shown by FIG. 8 has a stabilising pad 250 as shown but does not have cutters 264 within its middle section 248.

Figure 12:
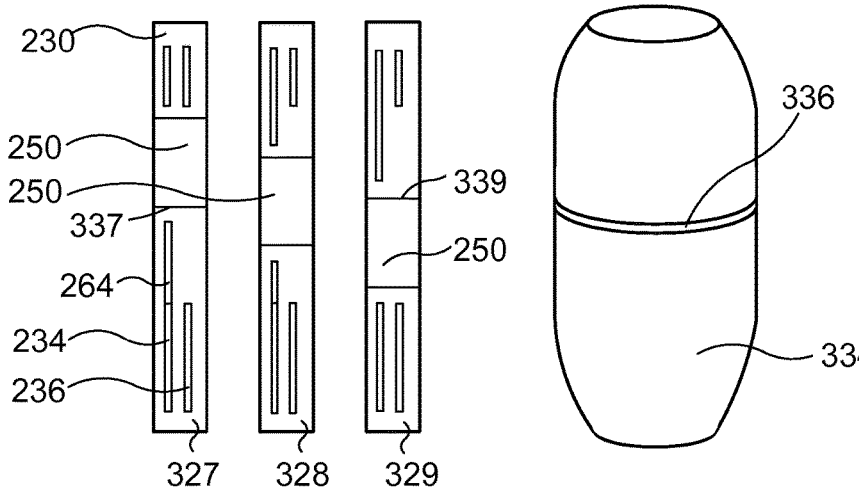
FIGS. 12 to 15 diagrammatically illustrate further sets of cutter blocks.

FIG. 12 illustrates a further possibility. Three cutter blocks 327, 328, 329 have stabilising pads 250 at axially different locations, but the lower of edge 337 of the stabilising pad on block 327 is slightly above the upper edge 339 of the stabilising pad on block 329. In consequence, the notional surface 334 swept out by the rotating blocks includes a narrow band 336 which is swept out exclusively by stabilising pads. However, the axial extent of this band is small, not more than 20% of the axial length of any stabilising pad, and will not prevent expansion of the cutter blocks if expansion is accompanied by slight axial movement of the reamer.

Figure 13:
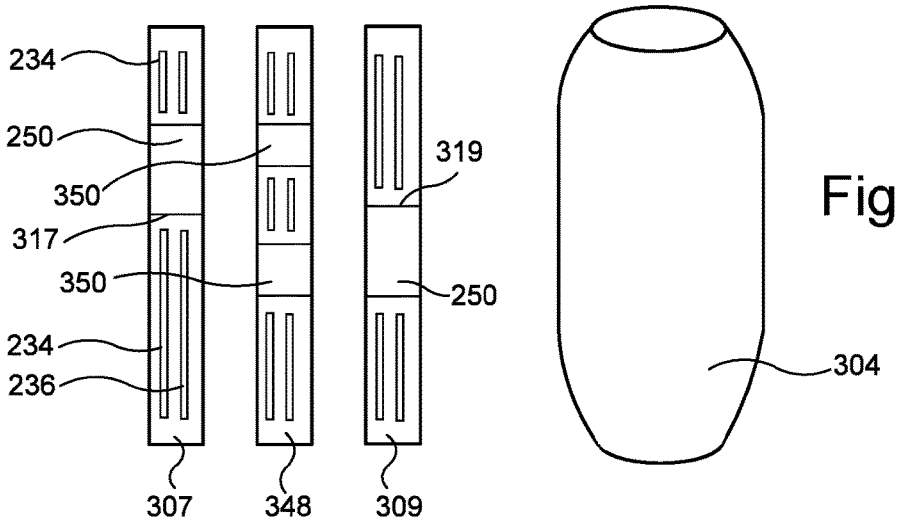

FIG. 13 shows a modified arrangement. Two of the cutter blocks 307, 309 are the same as those shown in FIGS. 7 and 9. However, the third block 348 has two stabilising pads 350 which have a smaller axial extent than stabilising pads 250 on the other blocks and have an additional cutting region 352 between them.

Figure 14:
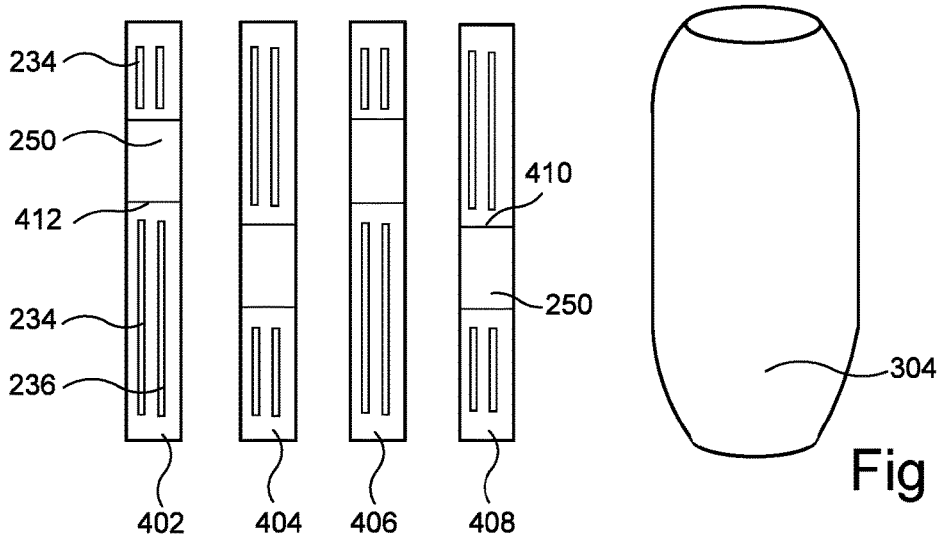

FIG. 14 shows an arrangement with four cutting blocks which would be positioned at 90° intervals around the axis of the reamer. The blocks 402 and 406 are identical. The blocks 404 and 408 are identical to each other and have stabilising pads 250 nearer the bottom of the blocks. The upper edges 410 of the stabilising pads 250 on blocks 404 and 408 are slightly below the lower edges 412 of stabilising pads 250 on the blocks 402 and 406.

The arrangements shown in both FIGS. 13 and 14 lead to a notional surface 304 swept by the rotating reamer's cutters and pads which has no band swept out exclusively by stabilising pads.

Figure 15:
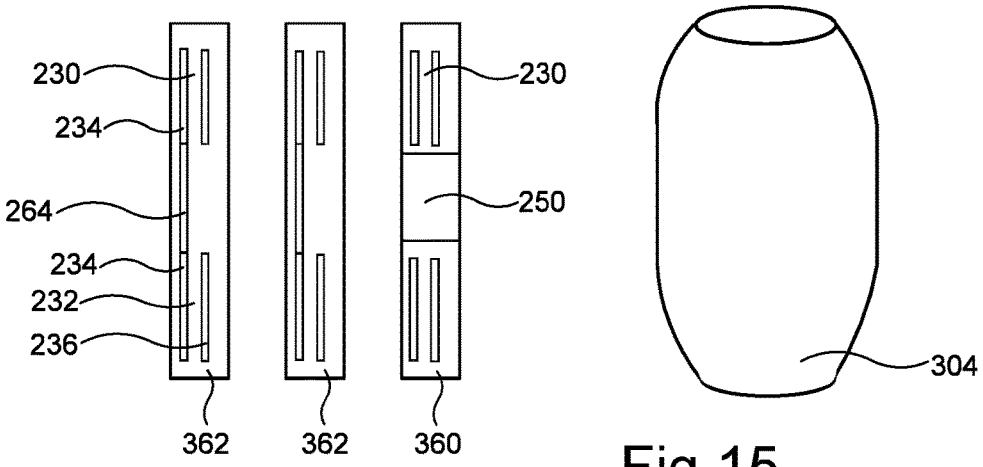

FIG. 15 shows a further possibility. There are again three cutter blocks. One of the blocks 360 has upper and lower cutting regions 230, 232 as described above while the axially middle section between them is entirely occupied by a stabilising pad 250. The remaining two blocks 362 are identical to each other. They likewise have upper and lower cutting regions 230, 232 which are the same as on block 360 while the axially middle section between them contains no stabilising pad and instead is a cutting region with a single row of cutters 264. During expansion of the reamer these cutters 264 are able to enlarge the borehole and allow expansion of the cutter blocks. Subsequently, during axial advance of the reamer, the single stabilising pad 250 contacts the borehole wall and positions the reamer centrally in the hole. In a variation of this arrangement, two identical blocks 360 with stabilising pads 250 are used with one block 362.

Figure 16:
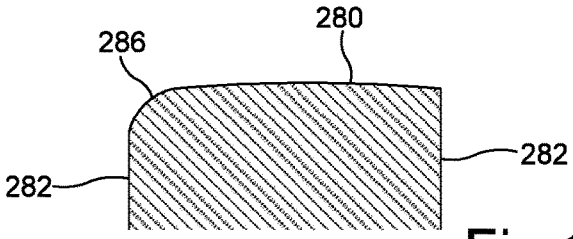
FIGS. 16 and 17 are cross sections through stabilising pads showing modifications.
Figure 17:
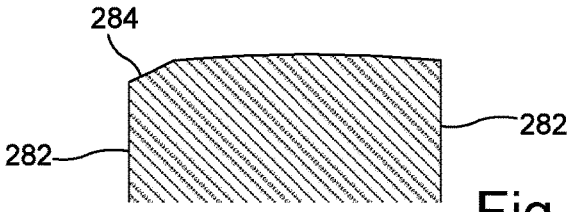

FIGS. 16 and 17 are cross sections through stabilising pads showing variations. The surface 280 which faces the borehole wall extends between side faces 282. At one axial edge, which is the leading edge during rotation of the reamer, there is an inclined plane surface 284 or a curved surface 286, serving to reduce shock on impact with any roughness projecting from the borehole wall and hence reduce vibration.

Figure 18:
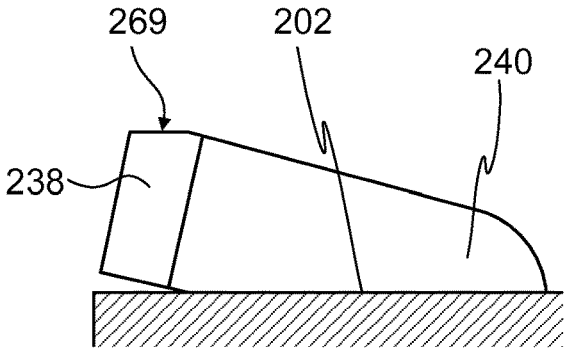
FIG. 18 shows a modification to a cutter.

FIG. 18 shows a slightly different PDC cutter. It is generally similar to that shown in FIG. 5, but the radially outer part of the PDC disc 238 has been chamfered to a face transverse to the plane of the paper which appears in the drawing as line 269. For the radially outermost cutters including the cutters 264, it is this surface which lies at the gauge radius when the blocks 202 are fully expanded, and the front surfaces of the stabilising pads 250 are aligned or approximately aligned with these surfaces 269 of the outermost cutters.

Experimental Testing

Test 1 A borehole was drilled into rock using a drilling assembly which (as in FIG. 1) had a drill bit at the bottom end and an expandable reamer higher up the assembly. The reamer had cutter blocks of conventional construction with under-gauge stabilising pads at the same axial position on all cutting blocks. The assembly included stabilisers and drill collars between the reamer and drill bit and also included motion sensors just above the drill bit and just above the reamer.

Analysis of the recorded motion showed that there was vibration with high amplitude, indicating high lateral vibration of the reamer. It was also apparent from the recorded data that this movement of the reamer was propagating along the drill string and interfering with the proper motion of the drill bit.

Subsequently a remote camera was lowered into the reamed out part of the borehole and revealed that the borehole wall had been gouged into deep helical grooves extending well outside the gauge radius of the fully expanded reamer.

Test 2 A test rig was used to compare three reamers, each having three cutting blocks held at fully expanded position. These were (i) a conventional reamer having under gauge stabilising pads at the same axial position on all cutting blocks, (ii) a reamer having full gauge stabilising pads at the same axial position on all cutting blocks, and (iii) a reamer having full gauge stabilising pads at different axial positions on the cutting blocks as in FIG. 11.

These reamers were used to ream through blocks of rock. It was found that the conventional reamer (i) made a transition from an apparently satisfactory rotating state to a very strongly vibrating state with a low rate of penetration. The vibration could not then be reduced by increasing the weight applied to the reamer. This phenomenon did not occur with either of the reamers (ii) and (iii) having stabilising pads at full gauge and with these the rate of penetration remained dependent on the weight applied to the reamer. Vibration of the reamers (ii) and (iii) with full gauge pads was of lesser amplitude than the vibration of the conventional reamer (i).

Subsequent examination of the reamed blocks of rock showed that the reamer (iii) had produced a cylindrical hole with a smoother wall than that produced by the conventional reamer (i) which had made a pattern of helical grooves in the wall.

Figure 20A:
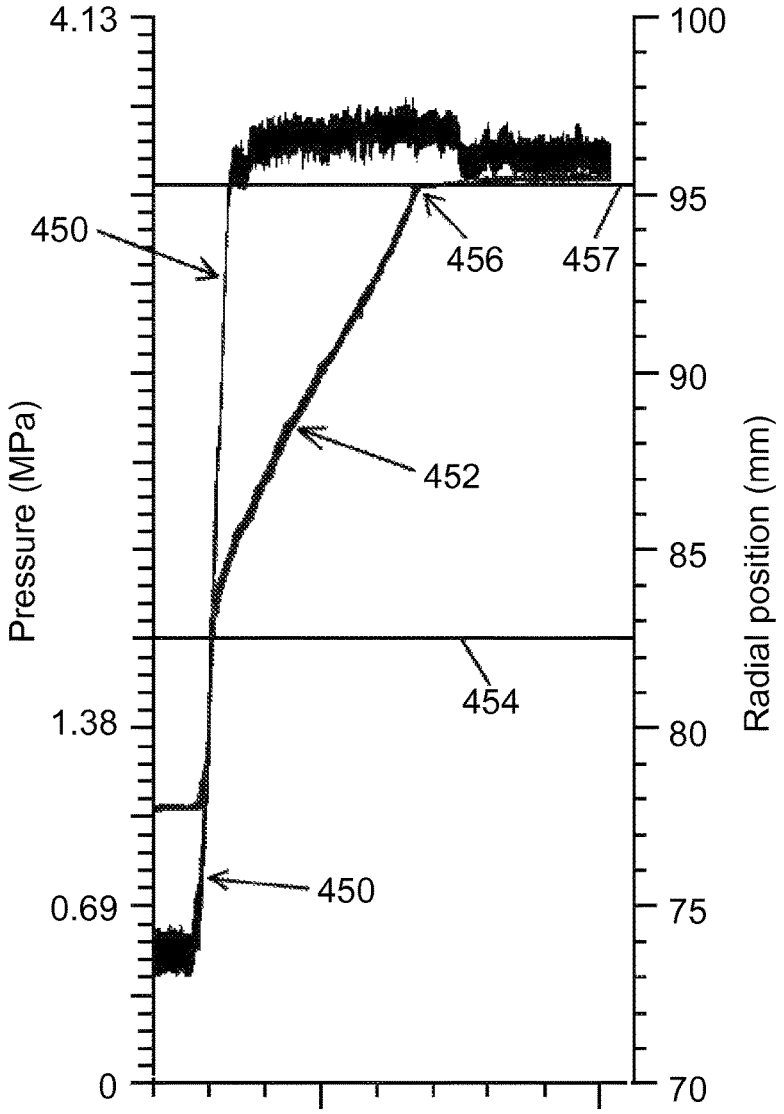
FIGS. 20A and 20B are a pair of graphs showing test results with a conventional reamer as shown by FIG. 10.
Figure 20B:
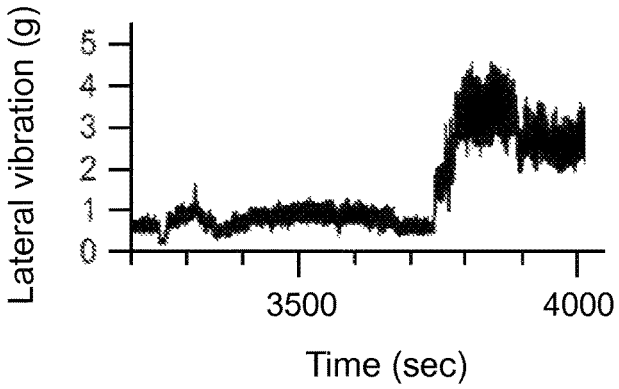

Test 3 A different test rig was used to compare two reamers, each having three cutting blocks movable between retracted and expanded positions by hydraulic pressure supplied along a drill string to the reamer in the manner explained above with reference to FIGS. 2 and 3. One reamer was a conventional reamer with under-gauge stabilising pads at the same axial position on all cutting blocks; results from this are shown in FIGS. 20A and 20B. The second reamer had cutter blocks which included full gauge stabilising pads at different axial positions on the cutting blocks. However, the cutter blocks were longer than those in FIG. 11 and the lower edge 440 of the gauge pad 250 on block 307 was slightly above the upper edge 442 of the gauge pad on block 308. Similarly, the lower edge 444 of the gauge pad on block 308 was slightly above the upper edge of the gauge pad 250 on block 309. Numeral 448 indicates the PDC cutters, but their mounting and positions are not shown in detail. The results with this second reamer are shown in FIGS. 21A and 21B.

Both of these reamers were fitted with motion sensors to monitor vibration and sensors to monitor the radial expansion of the cutter blocks. For testing, each reamer was included in a drill string and inserted into an existing, i.e. previously drilled, hole in a heterogenous rock formation. The drill string was rotated and hydraulic pressure was supplied along the drill string to expand the cutter blocks. When the cutter blocks had expanded fully the portion of the hole around the reamer had been enlarged from its original diameter of 16.5 cm (6.5 inches) to a larger diameter of 19 cm (7.5 inches). The drill string was then advanced axially, thus enlarging a length of the hole to the larger diameter.

FIG. 20A and FIG. 20B show the significant portion of results with the conventional reamer. Both graphs have the same horizontal axis which is time from the starting point of the experimental test. The hydraulic pressure is indicated by trace 450 in the upper graph which is FIG. 20A and the position of the cutter blocks is indicted by trace 452. It can be seen that rising hydraulic pressure initially expanded the blocks into contact with the wall of the existing hole. This took place at a pressure of approx. 0.96 MPa (140 psi) and this contact with the hole is indicated by horizontal line 454. As the hydraulic pressure increased further to reach a constant pressure of 3.8 MPa (550 psi) the cutter blocks progressively expanded further as indicated by trace 452, enlarging a portion of the hole, until they reached their fully expanded position at point 456 on horizontal line 457 which denotes full expansion. The drill string was then advanced axially. Lateral vibration is shown in the lower graph which is FIG. 20B. This is a plot of measured lateral accelerations relative to the magnitude of free fall acceleration under gravity at the Earth's surface (g).

Figure 19:
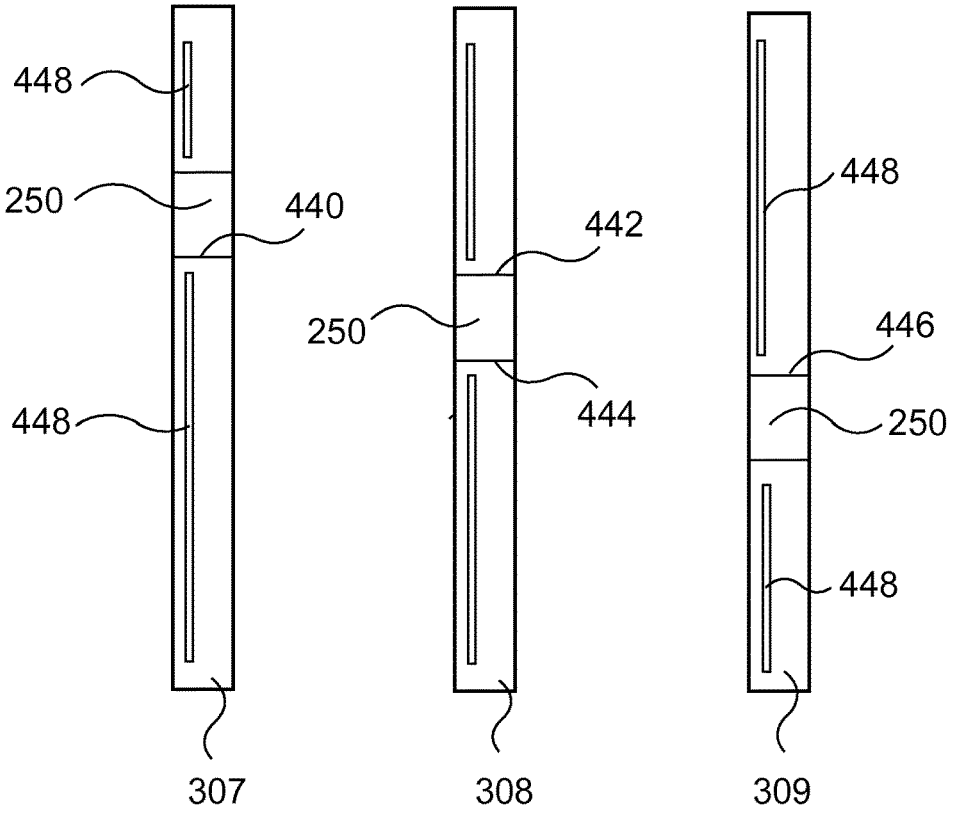
FIG. 19 diagrammatically illustrates a set of cutter blocks with some differences from those in FIG. 11.
Figure 21A:
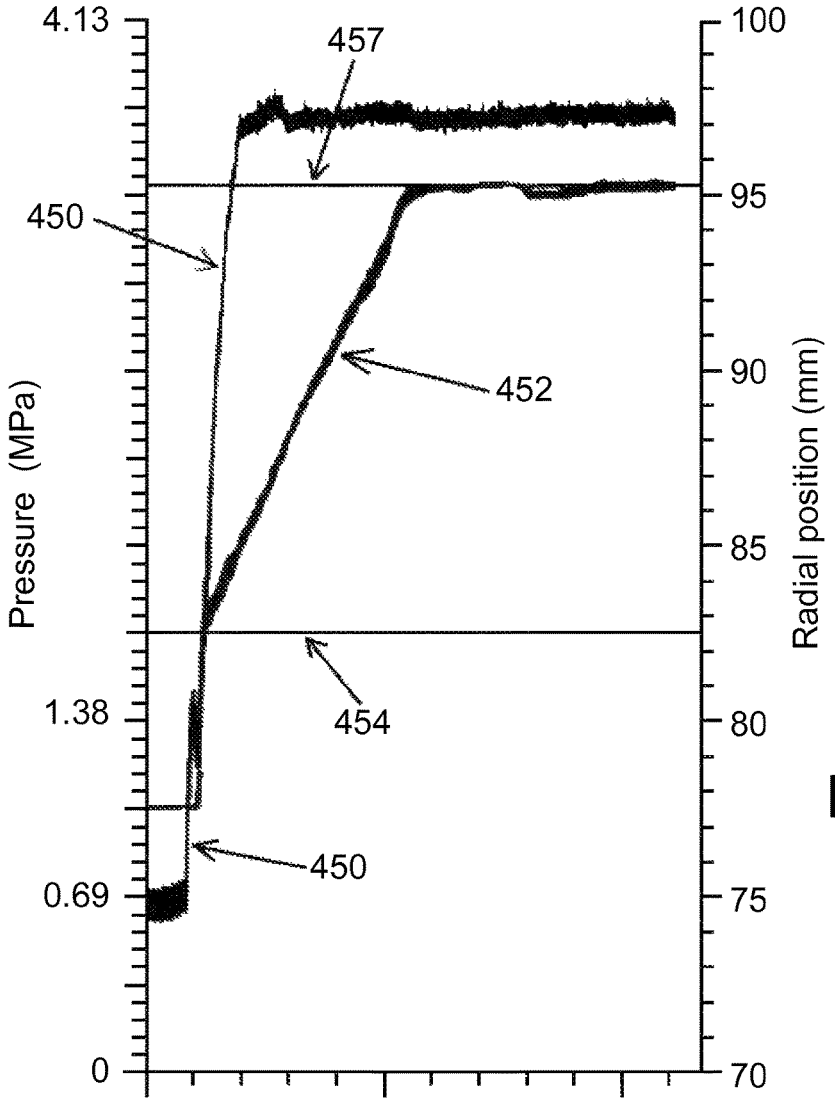
FIGS. 21A and 21B are a similar pair of graphs showing test results with a reamer having cutter blocks as shown by FIG. 19.
Figure 21B:
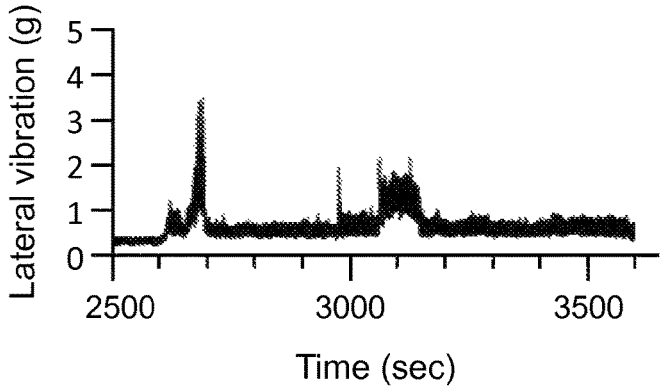

FIGS. 21A and 21B are corresponding graphs obtained with the reamer in accordance with FIG. 19. Once again, as the hydraulic pressure increased the cutter blocks expanded to contact the wall of the previously drilled hole and then progressively expanded further to reach the fully expanded position indicated by line 457. This demonstrated that the novel reamer with gauge pads at full gauge and at differing axial positions as shown by FIG. 19 was able to expand, enlarging a portion of the borehole as it does so, in a similar length of time to that required for expansion of a conventional reamer.

After expansion of the cutter blocks, the drill string was advanced axially and the measured vibration is shown in FIG. 21B. This shows that the magnitude of lateral vibration rose briefly as axial advance commenced but then settled to a value less than 1 g.

It will be appreciated that the example embodiments described in detail above can be modified and varied within the scope of the concepts which they exemplify. Features referred to above or shown in individual embodiments above may be used together in any combination as well as those which have been shown and described specifically. Accordingly, all such modifications are intended to be included within the scope of this disclosure as defined in the following claims.

The invention claimed is:

1. An expandable reaming tool for enlarging a borehole comprising:

a plurality of support elements distributed around a central axis of the tool where at least one of the support elements comprises at least one cutting region comprising cutters and at least one support element comprises a stabilising pad having a front surface positioned to face the wall of the borehole; and means for expanding the support elements radially outwardly from the central axis;

wherein the support elements differ in the cutting regions and stabilising pads thereon such that at least one support element differs from at least one other support element in the presence or axial position of at least one stabilising pad;

wherein the cutters extend to a gauge radius from the tool axis and the front faces of the stabilising pads extend to a maximum radius which is less than the gauge radius, but the difference between the gauge radius and the maximum radius of the stabilising pads is not more than 0.5 mm.

2. The tool according to claim 1 wherein axial locations of stabilising pads and cutting regions differ between support elements, such that the axial length along the tool occupied by each stabilising pad on any one support element is at least partially occupied by one or more cutting regions of one or more other support elements.

3. The tool according to claim 1 wherein at least 75% of the axial length along the tool occupied by each stabilising pad on any one support element is occupied by one or more cutting regions of one or more other support elements.

4. The tool according to claim 1 wherein the whole of the axial length along the tool occupied by each stabilising pad on any one support element is occupied by one or more cutting regions of one or more other support elements.

5. The tool according to claim 1 wherein each support element comprises an inclined cutting region which extends both axially and radially relative to the tool axis.

6. The tool according to claim 1 wherein each support element comprises an inclined cutting region which extends both axially and radially relative to the tool axis and also comprises a region which extends axially relative to the tool axis and comprises at least one of a stabilising pad and a cutting region in which a plurality of cutters are at the same radial distance from the tool axis.

7. The according to claim 1 wherein the tool comprises at least three support elements and each support element comprises at least one cutting region comprising cutters and at least one stabilising pad, and wherein the axial locations of the stabilising pads differ between the support elements.

8. The tool according to claim 1 wherein the tool comprises at least three support elements, including at least one with a stabilising pad and at least one other without any stabilising pad.

9. The tool according to claim 1 wherein means for expanding the support elements comprises a drive mechanism acting on all the support elements simultaneously to move them outwardly in unison and by equal extent.

10. The tool according to claim 1 wherein the front face of at least one stabilising pad is connected to a side face of the pad by a sloping intermediate surface along an axial edge of the pad.

11. The tool according to claim 10 wherein the intermediate surface is a curved surface extending from the front face to the side face of the pad.

12. A method of enlarging a borehole by expanding a reaming tool according to claim 1 within the borehole and rotating and axially advancing the tool along the borehole.

13. A method of drilling a borehole with a drilling assembly comprising a drill bit and also a reamer according to claim 1, with the reamer spaced from the drill bit by at least 10 meters, expanding the reamer within the borehole, and rotating and advancing the drill bit to create and extend a pilot hole at the downhole end of the borehole while simultaneously rotating and advancing the reamer to enlarge the pilot hole.

* * * * *